US007728783B2

(12) United States Patent
Su et al.

(10) Patent No.: US 7,728,783 B2
(45) Date of Patent: Jun. 1, 2010

(54) ANTENNA STRUCTURE

(75) Inventors: Jia-Hung Su, Tu-Cheng (TW); Ching-Chi Lin, Tu-Cheng (TW); Hung-Jen Chen, Tu-Cheng (TW); Kai Shih, Tu-Cheng (TW); Yu-Yuan Wu, Tu-Cheng (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 202 days.

(21) Appl. No.: 11/828,934

(22) Filed: Jul. 26, 2007

(65) Prior Publication Data

US 2009/0027275 A1 Jan. 29, 2009

(51) Int. Cl.
*H01Q 1/48* (2006.01)
*H01Q 9/42* (2006.01)

(52) U.S. Cl. ..... 343/846; 343/829

(58) Field of Classification Search ..... 343/700 MS, 343/702, 829, 846, 828, 848
See application file for complete search history.

(56) References Cited

U.S. PATENT DOCUMENTS 6,650,294 B2 * 11/2003 Ying et al. ..... 343/700 MS

* cited by examiner

*Primary Examiner*—Michael C Wimer
(74) *Attorney, Agent, or Firm*—Birch, Stewart, Kolasch & Birch, LLP

(57) ABSTRACT

An antenna structure includes a connection portion. A feed portion connecting to the connection portion defines a feed point thereon. An inductance portion extends from the connection portion, and a free end of the inductance portion connects to a ground end. A capacitance portion that is in a long narrow strip shape extends from the connection portion and is parallel with and adjacent to the ground end. And radiating portions connect to the connection portion respectively. The antenna structure employs the inductance portion, the capacitance portion and the ground end to simulate a LC parallel connection to substitute for an inductor and a capacitor. Therefore, the antenna structure achieves an aim of adjusting a resonance frequency and an impedance matching without the inductor and the capacitor, simplifying the design of the antenna structure, decreasing the manufacture cost and attaining a good performance.

15 Claims, 2 Drawing Sheets

ANTENNA STRUCTURE

BACKGROUND OF THE INVENTION

1. Field of the Invention

The present invention relates to an antenna structure, and more particularly to a multi-band frequency antenna structure used in mobile communication equipment.

2. The Related Art

Antennas are used in various communication systems, such as cellular phones, wireless data and local area network, global system for mobile communications (GSM), and personal communication service (PCS), etc. A clear and strong signal is critical for the wireless communication systems. Therefore, antennas with good performance are required. In order to improve the performance of the antennas, capacitance elements and inductance elements are broadly used in the antennas to adjust a resonance frequency and an impedance matching of the antennas.

Please refer to FIG. 1 showing a conventional antenna structure. The conventional antenna structure includes an antenna body 100 constructed of a first radiating unit 120 and a second radiating unit 130. A feed point 110 is disposed on the antenna body 100 and spaces the first radiating unit 120 and the second radiating unit 130. The first radiating unit 120 extends toward an end of the second radiating unit 130 to form a projection 121. A first capacitor 200 and an inductor 300 are connected in parallel and then connect to the feed point 110 and the ground respectively. The LC parallel connection circuit enables the antenna body 100 and a high-frequency circuit to match with each other. A second capacitor 400 connects with the projection 121 of the first radiating unit 120 and the second radiating unit 130 in series in order to adjust the electrical length of the second radiating unit 130.

If the conventional antenna structure described above is assembled in a hand-held apparatus, the first capacitor 200, the inductor 300 and the second capacitor 400 can be fixed on a PCB of the hand-held apparatus because the antenna and the PCB are adjacent to each other. However, if the antenna structure is assembled in a notebook computer, because the antenna structure is mounted on a top of a monitor of the notebook computer, and a PCB of the notebook computer is disposed on a host of the notebook computer, the distance between the antenna and the PCB is far, then the first capacitor 200, the inductor 300 and the second capacitor 400 can't be disposed on the PCB of the notebook computer and must be integrated with the antenna structure. Therefore, the design and the manufacture of the antenna structure are complex, and the cost is very expensive.

SUMMARY OF THE INVENTION

A first object of the present invention is to provide an antenna structure for simplifying the design and decreasing the manufacture cost thereof by a way of simulating a LC parallel connection to substitute for an inductor and a capacitor.

A second object of the present invention is to provide an antenna structure for simplifying the design and decreasing the manufacture cost thereof by a way of simulating a capacitance parallel connection to substitute for a capacitor.

In order to achieve the first object, the antenna structure of the present invention includes a connection portion. A feed portion connecting to the connection portion defines a feed point. An inductance portion extends from the connection portion, and a free end of the inductance portion connects to a ground end. A capacitance portion that is in a long narrow strip shape extends from the connection portion and is parallel with and adjacent to the ground end. And radiating portions connect to the connection portion respectively.

In order to achieve the second object, the antenna structure of the present invention includes a connection portion. A feed portion connecting to the connection portion defines a feed point. A capacitance portion that is in a long narrow strip shape extends from the connection portion and is parallel with and adjacent to a ground end. And radiating portions connect to the connection portion respectively.

As mentioned above, the antenna structure employs the inductance portion, the capacitance portion and the ground end to simulate the LC parallel connection to substitute for the inductor and the capacitor. Therefore, the antenna structure achieves an aim of adjusting a resonance frequency and an impedance matching without the inductor and the capacitor, simplifying the design of the antenna structure, decreasing the manufacture cost and attaining a good performance.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENT

Figure 1:
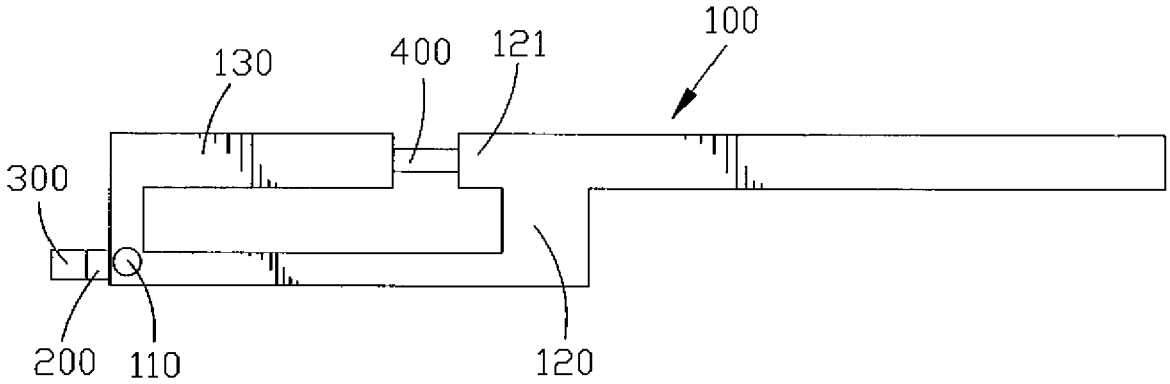
FIG. 1 (Prior Art)
FIG. 1 is a perspective view of a conventional antenna structure.
Figure 2:
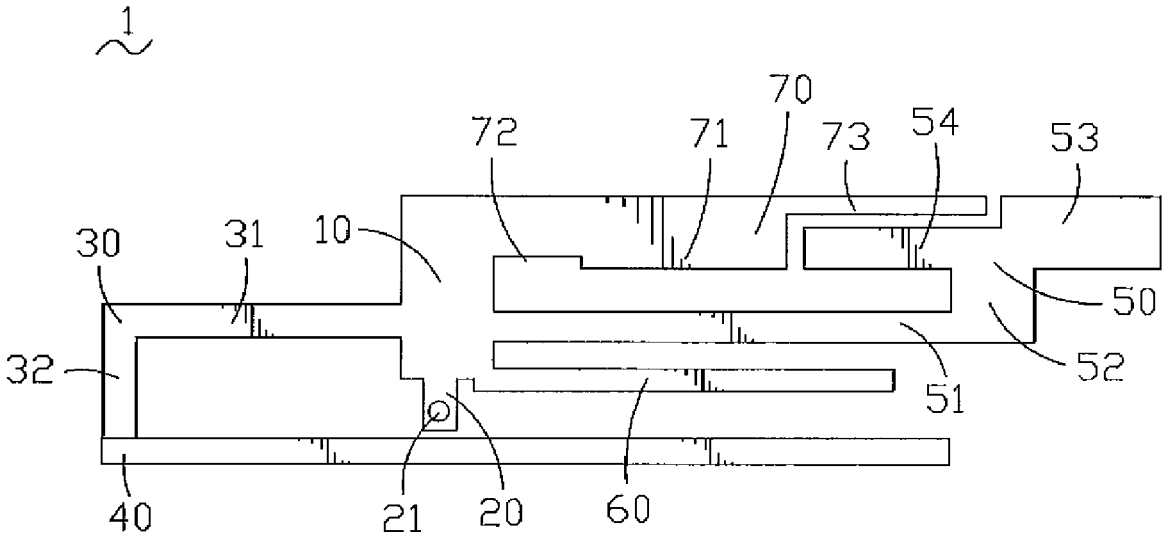
FIG. 2 is a perspective view of an antenna structure of the present invention.

An antenna structure 1 according to a preferred embodiment of the present invention is illustrated in FIG. 2. The antenna structure 1 which may be formed by pattern etching a copper-plated sheet of synthetic material includes a rectangular board-shaped connection portion 10. A bottom of the connection portion 10 extends downward to form a feed portion 20 from substantial the center thereof. The feed portion 20 is narrower than the connection portion 10. A feed point 21 is disposed on the feed portion 20. A left side of the connection portion 10 horizontally extends leftward and then bends downward to form a L-shaped inductance portion 30 which is threadlike, so the inductance portion 30 has a transverse inductance strip 31 perpendicularly extending from the left side of the connection portion 10 and a longitudinal inductance strip 32 perpendicularly extending from a rear end of the transverse inductance strip 31. A free end of the longitudinal inductance strip 32 connects with a ground end 40.

A right side of the connection portion 10 horizontally extends rightward to form a first radiating portion 50 including a transverse radiating strip 51 opposite to the transverse inductance strip 31 of the inductance portion 30. A rear end of the transverse radiating strip 51 extends upward, forming a longitudinal radiating strip 52. A top end of the longitudinal radiating strip 52 stretches upward and simultaneously extends outward to define a first capacitance portion 54 at left thereof, and the longitudinal radiating strip 52 further projects upward at right thereof, defining a rectangular radiating end 53 which is parallel with the transverse radiating strip 51 and is higher than the first capacitance portion 54. The electrical length of the first radiating portion 50 is a quarter wavelength of an electromagnetic wave whose frequency is 900 MHz.

The bottom end of the connection portion 10 horizontally extends rightward from the right side thereof to define a long narrow strip-shaped capacitance portion 60. The top surface of the capacitance portion 60 is under and parallel with the transverse radiating strip 51. The bottom surface of the capacitance portion 60 is parallel with and adjacent to the ground end 40 which extends rightward from the free end of the longitudinal inductance strip 32.

A top end of the connection portion 10 horizontally extends rightward from the right side thereof to define a second radiating portion 70. The right of the bottom of the second radiating portion 70 stretches downward to form an extension portion 71, so a concave 72 is formed between the extension portion 71 and the right side of the connection portion 10. The second radiating portion 70 extends rightward continually and becomes narrow to define a second capacitance portion 73 which is above and parallel with the first capacitance portion 54. The bottom surface of the second capacitance portion 73 is adjacent to the top surface of the first capacitance portion 54. The right side of the extension portion 71 is adjacent to the left side of the first capacitance portion 54. The electrical length of the second radiating portion 70 is a quarter wavelength of an electromagnetic wave whose frequency is 1800 MHz.

When the antenna structure 1 is assembled in a mobile communication equipment, the ground end 40 of the antenna structure 1 is connected to the ground. So the inductance portion 30 connects with the ground through the ground end 40. Because the inductance portion 30 is a long narrow strip metal, the inductance portion 30 has a property of linearity. Therefore, the connection between the inductance portion 30 and the ground end 40 can substitute for an inductor to attain the same function. The capacitance portion 60 is a long narrow strip and is parallel with and adjacent to the ground end 40, so the capacitance portion 60 and the ground end 40 produce a capacitance effect and can substitute a capacitor to attain the same function. Thereby, the inductance portion 30 and the capacitance portion 60 enable the antenna structure 1 and a high-frequency circuit to match with each other.

The first radiating portion 50 produces a main resonance mode to secure the first radiating portion 50 send/receive an electromagnetic signal of GSM 850 MHz and 960 MHz frequency bands. The second capacitance portion 73 is above and parallel with the first capacitance portion 54, and the bottom surface of the second capacitance portion 73 is adjacent to the top surface of the first capacitance portion 54, so the collocation structure of the second capacitance portion 73 and the first capacitance portion 54 can be equivalent to a series capacitor to connect the first radiating portion 50 to the second radiating portion 70. Then, when the second radiating portion 70 sends/receives an electromagnetic signal of high frequency, the first capacitance portion 54 and second capacitance portion 73 produce a capacitance effect therebetween to increase the electrical length of the second radiating portion 70. Therefore, the second radiating portion 70 can sends/receives an electromagnetic signal of DCS 1800 MHz and WCDMA 2100 MHz frequency bands.

It can be seen that the antenna structure 1 employs the inductance portion 30, the capacitance portion 60 and the ground end 40 to simulate a LC parallel connection in order to substitute for the inductor and the capacitor. Moreover, the collocation structure of the second capacitance portion 73 and the first capacitance portion 54 can be equivalent to a series capacitor. Therefore, the antenna structure 1 achieves an object of adjusting a resonance frequency and an impedance matching without the inductor and the capacitors, simplifying the design of the antenna structure 1, decreasing the manufacture cost and attaining a good performance.

The foregoing description of the present invention has been presented for purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. An antenna structure, comprising:

a connection portion;

a feed portion connecting to the connection portion, defining a feed point;

an inductance portion, extending from the connection portion, a free end of the inductance portion connecting to a ground end;

a capacitance portion in a long narrow strip shape, extending from the connection portion, parallel with and adjacent to the ground end; and at least one radiating portion, connecting to the connection portion respectively; and wherein the inductance portion is L-shaped;

wherein the connection portion horizontally extends leftward and then bends downward to form the L-shaped inductance portion, so the inductance portion has a transverse inductance strip perpendicularly extending from the left side of the connection portion and a longitudinal inductance strip perpendicularly extending from a rear end of the transverse inductance strip, the free end of the longitudinal inductance strip connects with the ground end.

2. The antenna structure as claimed in claim 1, wherein the connection portion extends downward to form the feed portion from substantial the center thereof.

3. The antenna structure as claimed in claim 1, wherein the radiating portion includes a first radiating portion and a second radiating portion, the first radiating portion has a transverse radiating strip extending horizontally and rightward from a right side of the connection portion, a rear end of the transverse radiating strip extends upward, forming a longitudinal radiating strip, a top end of the longitudinal radiating strip stretches upward and simultaneously extends outward to define a first capacitance portion at left thereof, and the longitudinal radiating strip further projects upward at right thereof, defining a radiating end, the second radiating portion horizontally extending rightward from the right side of the connection portion extends rightward and becomes narrow to define a second capacitance portion which is parallel with and adjacent to the first capacitance portion.

4. The antenna structure as claimed in claim 3, wherein the right of the bottom of the second radiating portion stretches downward to form an extension portion, so a concave is formed between the extension portion and the right side of the connection portion.

5. The antenna structure as claimed in claim 4, wherein the right side of the extension portion is adjacent to the left side of the first capacitance portion.

6. The antenna structure as claimed in claim 1, wherein the bottom end of the connection portion horizontally extends rightward from the right side thereof to define the capacitance portion.

7. An antenna structure, comprising:

a connection portion;

a feed portion connecting to the connection portion, defining a feed point;

a capacitance portion in a long narrow strip shape, extending from the connection portion, parallel with and adjacent to a ground end; and at least one radiating portion, connecting to the connection portion respectively; and wherein the radiating portion includes a first radiating portion and a second radiating portion, the first radiating portion has a transverse radiating strip extending horizontally and rightward from a right side of the connection portion, a rear end of the transverse radiating strip extends upward, forming a longitudinal radiating strip, a top end of the longitudinal radiating strip stretches upward and simultaneously extends outward to define a first capacitance portion at left thereof, and the longitudinal radiating strip further projects upward at right thereof, defining a radiating end, the second radiating portion horizontally extending rightward from the right side of the connection portion extends rightward and becomes narrow to define a second capacitance portion which is parallel with and adjacent to the first capacitance portion.

8. The antenna structure as claimed in claim 7, wherein the connection portion extends downward to form the feed portion from substantial the center thereof.

9. The antenna structure as claimed in claim 7, wherein the right of the bottom of the second radiating portion stretches downward to form an extension portion, so a concave is formed between the extension portion and the right side of the connection portion.

10. The antenna structure as claimed in claim 9, wherein the right side of the extension portion is adjacent to the left side of the first capacitance portion.

11. The antenna structure as claimed in claim 7, wherein the bottom end of the connection portion horizontally extends rightward from the right side thereof to define the capacitance portion.

12. An antenna structure, comprising:

a ground;

a connection portion;

an inductance portion in a long narrow strip shape, one end of the inductance connecting to the connection portion, the other end of the inductance portion connecting to the ground;

a capacitance portion in a long narrow strip shape, and parallel with and adjacent to the ground, one end of the capacitance portion connecting to the connection portion, the other end of the capacitance portion being of a free end;

at least one radiating portion connecting to the connection portion;

a feed point locating at the connection portion and being close to the capacitance portion and providing current;

the current directly flowing through the connection portion and directly flowing to the capacitance portion to excite a capacitance effect between the ground and the capacitance portion for tuning an antenna matching;

the current directly flowing through the connection portion and the inductance portion and directly flowing to the ground to excite the inductance portion functioning as an inductance for tuning the antenna matching; and the current directly flowing through the connection portion and directly flowing to the radiating portion to excite at least one frequency range, wherein the inductance portion is L-shaped, and wherein the connection portion horizontally extends leftward and then bends downward to form the L-shaped inductance portion, so the inductance portion has a transverse inductance strip perpendicularly extending from the left side of the connection portion and a longitudinal inductance strip perpendicularly extending from a rear end of the transverse inductance strip, the free end of the longitudinal inductance strip connects with the ground.

13. The antenna structure as claimed in claim 12, wherein radiating portion include a first radiating portion and a second radiating portion, the first radiating portion has a transverse radiating strip extending horizontally and rightward from a right side of the connection portion, a rear end of the transverse radiating strip extends upward, forming a longitudinal radiating strip, a top end of the longitudinal radiating strip stretches upward and simultaneously extends outward to define a first capacitance portion at left thereof, and the longitudinal radiating strip further projects upward at right thereof, defining a radiating end, the second radiating portion horizontally extending rightward from the right side of the connection portion extends rightward and becomes narrow to define a second capacitance portion which is parallel with and adjacent to the first capacitance portion.

14. The antenna structure as claimed in claim 13, wherein the right of the bottom of the second radiating portion stretches downward to form an extension portion, so a concave is formed between the extension portion and the right side of the connection portion.

15. The antenna structure as claimed in claim 14, wherein the right side of the extension portion is adjacent to the left side of the first capacitance portion.

* * * * *